US005772796A

United States Patent [19]

Kim

[11] Patent Number: 5,772,796

[45] Date of Patent: Jun. 30, 1998

[54] TEMPERATURE STABLE PERMANENT MAGNET

[75] Inventor: Andrew S. Kim, Pittsburgh, Pa.

[73] Assignee: YBM Magnex International, Inc., Newtown, Pa.

[21] Appl. No.: 560,888

[22] Filed: Nov. 20, 1995

[51] Int. Cl.[6] ..... H01F 1/055

[52] U.S. Cl. ..... 148/303; 148/301; 420/582

[58] Field of Search ..... 148/303, 301, 148/302; 420/582, 83

[56] References Cited

U.S. PATENT DOCUMENTS

| | | | |
|---|---|---|---|
| 3,982,971 | 9/1976 | Yamanaka et al. | 148/303 |
| 4,172,717 | 10/1979 | Tokunaga et al. . | |
| 4,276,097 | 6/1981 | Bergner et al. | 148/303 |
| 4,284,440 | 8/1981 | Tokunaga et al. | 148/303 |
| 4,375,996 | 3/1983 | Tawara et al. | 420/582 |
| 4,578,125 | 3/1986 | Sahashi et al. | 420/582 |
| 5,382,303 | 1/1995 | Anderson | 148/303 |

FOREIGN PATENT DOCUMENTS

| | | | |
|---|---|---|---|
| 0 156 483 A1 | 10/1985 | European Pat. Off. . | |
| 57-196502 | 12/1982 | Japan | 148/303 |
| 3-62775 | 9/1991 | Japan . | |

OTHER PUBLICATIONS

Chemical Abstracts, vol. 84, No. 8, Feb. 23, 1976.

Abdelnour et al., "Properties of Various Sintered Rare Earth–Cobalt Permanent Magnets Between –60° and + 200°C, " IEEE Transactions on Magnetics, vol. MAG–16, No. 5, Sep. 1980.

Temperature–Compensated 2:17 Type Permanent Magnets with Improved Magnetic Properties; Liu et al; J. Appl. Phys., vol. 65 (1990).

The Influence of 2:7 Phase on Magnetic Properties of SM2C017–Type Sintered Magnets; Fujimoto et al; R&D Laboratories, Nippon Steel Corp., pp. 653–661, 1989.

Recent Progress in 2:17–Type Permanent Magnets; Ray et al; JMEPEG (1992) 1:183–192.

A Comparison of Temperature Compensation in SMC05 and RE2(TM)17 as Measured in a Permeameter, a Traveling Wave Tube and an Inertial Device Over the Temperature Range of –60° to 200°C; Marlin S. Walmer; Electron Energy Corp., Landisville, PA, 1987.

Influence of Copper Concentration on the Magnetic Properties and Structure of Alloys; Popov et al; Phys. Met. Metall., vol. 70, No. 2, pp. 18–27 (1990).

Domain Structures of Two Sm–Co–Cu–Fe–Zr "2:17" Magnets During Magnetization Reversal; Li et al; J. Appl. Phys. 55 (6), Mar. 15, 1984.

Investigations of the Magnetic Properties and Demagnetization Process of an Extremely High Coercive Sm (Co, Cu, Fe, Zr)7,6 Permanent Magnet; Durst et al; Phys. Stat. Sol. (a) 108, 705 (1988).

Analytical Electron Microscope Study of High–and Low–Coercivity SmCo 2:17 Magnets; Fidler et al; Mat. Res. Soc. Symp. Proc. vol. 96, 1987.

New High Remanence Copper Bearing Magnet Alloys; Tawara et al; Paper No. VI–1 at the Second Int'l. Workshop on Rare Earth–Cobalt Permanent Magnets and Their Applns., Jun. 8–11, 1976.

(List continued on next page.)

*Primary Examiner*—John Sheehan

*Attorney, Agent, or Firm*—Finnegan, Henderson, Farabow, Garrett & Dunner, L.L.P.

[57] ABSTRACT

A rare earth element containing permanent magnet which retains its magnetic properties at elevated temperatures by a combination of reducing the temperature coefficient of intrinsic coercivity lower than –0.2%/°C., and increasing the intrinsic coercivity to over 10 $kO_e$.

6 Claims, 1 Drawing Sheet

OTHER PUBLICATIONS

Effects of Cycle–Aging on Magnetic Properties of Sm(Co, Fe, Cu, Ni, Zr)7,6 Magnets; Morimoto et al., J. Japan Inst. Metals, vol. 51, No. 5 (1987), pp. 458–464.

Thermal Stability of FIve Sintered Rare–Earth–Cobalt Magnet Types; Li et al; J. Appl. Phys. 63 (8), Apr. 15, 1988.

Microstructure of Aged (Co, Cu, Fe)7 Sm Magnets; Livingston et al; Journal of Applied Physics, vol. 48, No. 3, Mar. 1977.

Microstructure and Properties of Step Aged Rare Earth Alloy Magnets; Mishra et al; J. Appl. Phys. 52 (3), Mar. 1981.

Rare Earth–Cobalt Permanent Magnets; Strnat et al; Journal of Magnetism and Magnetic Materials 100 (1991) 38–56.

Temperature Stable 2:17/1:5 Composite Permanent Magnet Material; Kim; Crucible Research Center; Oct. 9, 1995.

TEMPERATURE STABLE PERMANENT MAGNET

BACKGROUND OF THE INVENTION

1. Field of the Invention

The invention relates to a rare earth element containing permanent magnet which retains its magnetic properties at elevated temperature so that it may be used in applications where elevated temperatures are encountered.

Permanent magnets containing one or more rare earth elements and a transition element are well known for use in a variety of magnet applications. These include applications where the assembly with which the magnet is used encounters elevated temperature conditions. These applications include electric motors and magnetic bearings operating in high temperature environments. In these high temperature applications, maximum operating temperatures as high as 400° to 750° C. are encountered and magnets employed in these applications must retain their magnetic properties at these temperatures.

2. Description of the Prior Art

As may be seen from the magnetic properties set forth in Table 1, the $Sm_2TM_{17}$ demonstrates the best temperature performance relative to the other magnet compositions of Table 1, particularly from the standpoint of energy product at elevated temperature.

TABLE 1

PROPERTIES OF VARIOUS PERMANENT MAGNETS

| | Alnico | Ferrite | $SmCo_5$ | $Sm_2TM_{17}$ | Nc—Fe—B |
|---|---|---|---|---|---|
| $(BH)_{max}(MGO_e)$ | 1–8 | 3–4 | 15–20 | 20–30 | 25–45 |
| $B_r$ (kG) | 7–14 | 3–4 | 8–9 | 9–11 | 10–14 |
| $H_{ci}$ ($kO_e$) | 0.5–2.0 | 3–5 | ≧15 | 10–30 | 10–30 |
| ˆa (20–150° C.) (%/°C.) | −0.013 | −0.19 | −0.045 | −0.03 | −0.1–0.12 |
| ˆb (20–150° C.) (%/°C.) | ? | 0.34 | −0.3 | −0.3 | −0.4–0.6 |
| $T_c$ (°C.) | 860 | 450 | 750 | 825 | 310–450 |
| Maximum Operating Temperature (°C.) | 500 | 250 | 250 | 300 | 100–250 |
| Corr. Res. | Exc. | Good | Good | Good | Poor/Fair |

Historically, studies of $Sm_2TM_{17}$ magnets have been categorized into those relating to remanence and energy product, intrinsic coercivity, and temperature compensation by reducing the coefficient of remanence. Characteristically, remanence is increased by the partial substitution of Co with Fe. Further improvements have been made by controlling the alloy composition and processing. A near zero temperature coefficient of remanence was achieved by the partial substitution of Sm with a heavy rare earth element such as Gd or Er. However, the intrinsic coercivity of magnets of this type decrease sharply with increased temperature up to about 200° C. The intrinsic coercivity is dependent upon the microstructure of these magnets and particularly is a fine cell structure consisting of 2:17 phase cells and cell boundaries of a 1:5 phase. The homogeneous precipitations inside the main phase cells pin the domain wall movement and thus enhance coercivity. The precipitation hardened 2:17 magnets are typically Sm(Co, Fe, Cu, Zr)x, with x=7.2–8.5. The 1:5 cell boundaries impede the domain wall motion which has a similar effect to that of homogeneous wall pinning. The magnets characterized by low intrinsic coercivity generally exhibit homogeneous wall pinning and high intrinsic coercivity magnets show strong inhomogeneities (mixed pinning). Therefore, the cell structure, cell boundaries, and intercell distance are important factors in determining the coercivity of these magnets. The microstructure is controlled by chemistry and heat treatment.

A high coercivity 2:17 magnet is preferred for high temperature applications.

OBJECTS OF THE INVENTION

It is accordingly a primary object of the present invention to provide a permanent magnet that exhibits near zero irreversible losses of magnetic properties at temperatures of 400° to 750° C.

SUMMARY OF THE INVENTION

In accordance with the invention, a rare earth element containing permanent magnet is provided having a Curie temperature of ≧750° C., a temperature coefficient of intrinsic coercivity of ≦−0.2%/°C., intrinsic coercivity at room temperature of ≧10 $kO_e$, a temperature coefficient of remanence of ≦−0.1%/°C., remanence at room temperature of ≧8 kG, and an energy product at room temperature of ≧15 $MGO_e$, with a maximum operating temperature of ≧300° C. Preferably, the Curie temperature is ≧800° C., temperature coefficient of intrinsic coercivity is ≦−0.15%/°C., intrinsic coercivity at room temperature is ≧15 $kO_e$, the temperature coefficient of remanence is ≦−0.03%/°C., the remanence at room temperature is ≧8 kG, and the energy product at room temperature is ≧15 $MGO_e$, with the maximum operating temperature being ≧500° C. More preferably, the temperature coefficient of intrinsic coercivity is ≦−0.10%/°C., the intrinsic coercivity at room temperature is ≧20 $kO_e$, the temperature coefficient of remanence is ≦−0.02%/°C., the remanence at room temperature is ≧8 kG, and the energy product at room temperature is ≧15 $MGO_e$, with the maximum operating temperature being ≧700° C.

The preferred microstructure of the magnet is $Sm_2Co_{17}$ phase cell structure, and a $SmCo_5$ phase cell boundaries.

The composition of the alloy preferably is $Sm(Co_{1-x-y-z}Fe_xCu_yM_z)_w$, where w is 6 to 8.5, x is 0.10 to 0.30, y is 0.05 to 0.15, z is 0.01 to 0.04. A heavy rare earth element may be substituted for Sm in an amount up to 50%. M is at least one of Zr, Hf, Ti, Mn, Cr, Nb, Mo, and W. Preferably, w is 6.5 to 7.5.

DESCRIPTION OF THE PREFERRED EMBODIMENTS

Figure 1:
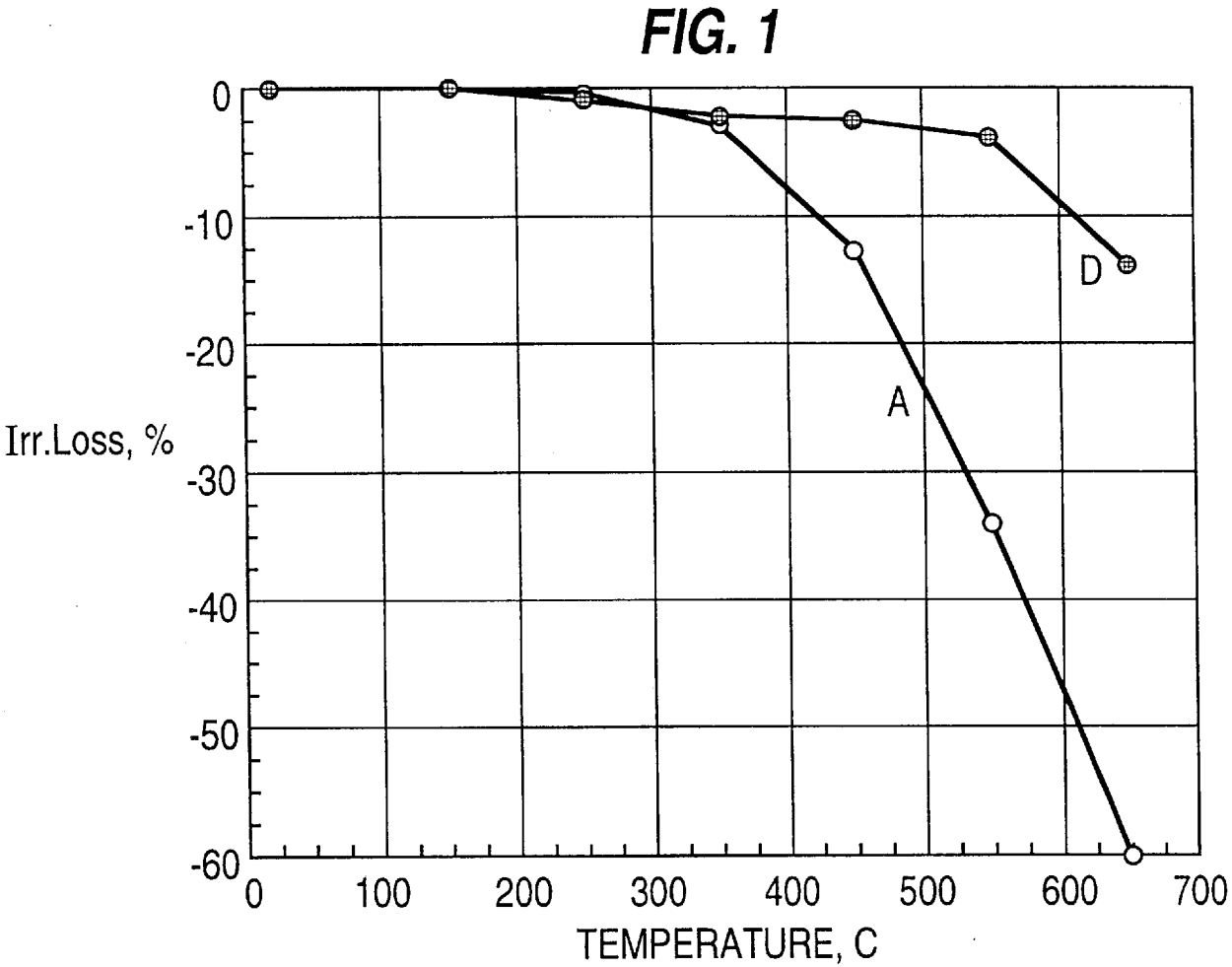
FIG. 1 is a graph showing irreversible losses of conventional magnets and magnets in accordance with the invention as a function of temperature.

Although improving the coercivity of 2:17 magnets (up to about 30 $kO_e$) increases the operating temperature, the maximum operating temperature limit is still about 300° C., which is well below typical high-temperature applications where temperatures of 400° to 750° C. are encountered. To increase the operating temperature range, it is necessary not only to increase coercivity, but also to reduce the temperature coefficient of coercivity. Hence, it is necessary to lower the temperature coefficient of coercivity along with increasing the intrinsic coercivity to increase the maximum operating temperature (MOT) over 400° C. Hence, in accordance with this invention, the magnets thereof characterized by enhanced temperature stability have a reduced temperature coefficient of coercivity and high intrinsic coercivity.

SPECIFIC EXAMPLES

Four $Sm_2TM_{17}$ magnets were produced and tested, with the compositions reported in Table 2.

TABLE 2

CHEMICAL COMPOSITIONS BY AT. % OF VARIOUS 2:17 ALLOYS

| Alloy | % Sm | % Co | % Fe | % Cu | % Zr | SM:TM |
|---|---|---|---|---|---|---|
| A | 11.3 | 59.8 | 20.5 | 6.0 | 2.0 | 1:7.8 |
| B | 11.7 | 57.0 | 24.5 | 4.8 | 2.0 | 1:7.6 |
| C | 6Sm/6Ce | 58.9 | 18.8 | 8.8 | 1.5 | 1:7.3 |
| D | 12.4 | 60.2 | 17.7 | 7.9 | 1.8 | 1:7.0 |

These alloys were melted in a vacuum induction melting furnace and melts were poured into a copper mold, with respect to alloys A, B, and C, or the melt was atomized into fine powder by the use of an inert gas, with alloy D. The alloys cast into the copper mold upon cooling and solidification were crushed to form powders. The crushed powders from alloys A, B, and C, and the atomized powders of alloy D, were further ground to fine powders having a particle size of about 4 to 8 microns by nitrogen gas jet milling. The milled powders were isostatically pressed while being magnetically aligned. The pressed compacts were sintered at temperatures between 1180°–1220° C. for 1.5 hours followed by homogenization at temperatures of 1170°–1190° C. for five hours. The sintered magnets were ground and sliced to form 15 mm diameter and 6 mm thick samples for testing. These samples were aged at 800°–850° C. for 8 to 16 hours followed by slow cooling.

The magnetic properties of the aged magnets were measured at room temperature and at 150° C. with a hysteresigraph and a high temperature search coil. The irreversible flux loss was estimated by measuring the flux difference with an Helmholtz coil before and after exposing the magnet to elevated temperatures. The magnet samples were held at temperatures up to 250° C. for one hour in a convection oven, and held for six hours each at temperatures of 350°, 450°, 550°, and 650° C., respectively, in a vacuum furnace. The permanence coefficient (Bd/Hd) was 1 because L/D was $6/15=0.4$. The Curie temperature was measured by a VSM.

The optimum magnetic properties of most alloys were obtained by sintering at 1200° C., 1175° C. homogenization, and 830° C. aging cycle. The magnetic properties of these magnet samples were measured at room temperature and are reported in Table 3.

TABLE 3

MAGNETIC PROPERTIES OF VARIOUS 2:17 MAGNETS

| Alloy | $B_r$, kG | $H_{ci}$, $kO_e$ | $H_c$, $kO_e$ | $H_k$, $kO_e$ | $BH_{max}$, $MGO_e$ |
|---|---|---|---|---|---|
| A | 10.0 | 28.5 | 9.4 | 11.2 | 25.2 |
| B | 10.9 | 2.1 | 1.5 | 1.5 | 12.8 |
| C | 9.0 | 0.7 | — | — | 2.7 |
| D | 8.3 | 18.6 | 7.9 | 13.2 | 16.8 |
| ½A + ½C | 8.7 | 17.8 | 6.4 | 3.5 | 15.4 |
| ½B + ½D | 10.2 | 31.5* | 9.5 | 13.8 | 25.0 |

*Estimated by extrapolation.

This data establishes that the standard magnet A exhibits a coercivity (28.5 $kO_e$) as high as that achieved conventionally. The Fe-rich, low copper containing magnet B exhibited a high remanence and low coercivity. The Ce substituted alloy magnet C, exhibited both a low remanence and extremely low coercivity. The Cu-enriched, 1:7 magnet sample D, exhibited a low remanence, moderately high intrinsic coercivity, and very good loop squareness.

Although alloys B and C produce low coercivity, the magnets of these blended alloys exhibited very high coercivities.

Since magnets made from alloys B and C exhibited very low coercivities, there were no further tests of these magnets. Magnets made from alloys A and D and from blends of A+C and B+D were measured at 150° C. with the same hysteresigraph. The intrinsic coercivity values at room temperature (21° C.) and at 150° C., and the calculated temperature coefficient of intrinsic coercivity between 21° and 150° C. are listed in Table 4.

TABLE 4

COERCIVITIES AT ROOM TEMPERATURE AND 150° C. AND TEMPERATURE COEFFICIENT OF $H_{ci}$ (β)

| Alloy | $H_{ci}$, Room Temp. $kO_e$ | $H_{ci}$, 150° C. $kO_e$ | β (21–150° C.) % °C.$^{-1}$ |
|---|---|---|---|
| A | 28.5 | 18.0 | −0.29 |
| D | 18.6 | 15.5 | −0.13 |
| ½A + ½C | 17.8 | 8.7 | −0.39 |
| ½B + ½D | 31.5* | 20.8 | −0.26 |

*Extrapolated value

The typical 2:17 magnet A exhibits a typical temperature coefficient of Hci of about −0.30%/°C. while magnet D exhibits a much lower value of −0.13%/°C.

The irreversible losses of the magnets at various temperatures are listed in Table 5.

TABLE 5

IRREVERSIBLE LOSSES (%) OF MAGNETS A AND D AFTER EXPOSURE TO ELEVATED TEMPERATURES

| Temp. (°C.) | A | D |
|---|---|---|
| 20 | 0.00 | 0.00 |
| 150 | 0.00 | 0.00 |
| 250 | −0.46 | −0.84 |
| 350 | −2.61 | −2.11 |
| 450 | −12.75 | −2.53 |
| 550 | −34.10 | −3.80 |
| 650 | −60.00 | −14.00 |

The irreversible losses of magnets A and D are plotted in FIG. 1. Magnet A starts to increase with respect to irreversible losses at 350° C., and magnet D at about 550° C. This indicates that although both high intrinsic coercivity and low temperature coefficients of intrinsic coercivity are essential for improving temperature stability, the latter is more effective than the former. The MOT is increased by reducing the temperature coefficient of intrinsic coercivity. This establishes that the magnet should have a temperature coefficient of coercivity lower than −0.15%/°C. and intrinsic coercivity greater than 15 $kO_e$ for applications at temperatures of 500° C. and higher.

The Curie temperature of the magnets A and D, measured with a VSM, are listed in Table 6.

TABLE 6

| CURIE TEMPERATURE OF MAGNETS A AND D | |
|---|---|
| Alloy | $T_c$ (°C.) |
| A | 825 |
| D | 840 |

The Curie temperatures are over 800° C. which is much higher than the desired operating temperature of 500° C.

Consequently, a magnet having an MOT over 500° C. in accordance with the invention is provided by reducing the temperature coefficient of intrinsic coercivity lower than −0.15%/°C. and increasing the intrinsic coercivity over 15 $kO_e$. A further increase in MOT to over 700° C. can be achieved by further reducing the temperature coefficient of coercivity lower than −0.1%/°C. and increasing the intrinsic coercivity greater than 20 $kO_e$. The reduction of the temperature coefficient of intrinsic coercivity (or the improvement in temperature stability) is due to the suppression of thermally activated domain wall motion, which is related to the microstructure of the magnet. Thus, the temperature stable magnet has a fine composite structure of 2:17 phase cell and thick 1:5 boundaries which consists of Sm, Co, Cu-rich phases.

The following are definitions of terms used herein:

VSM—vibrating sample magnetometer $B_r$—remanence $(BH)_{max}$—energy product $H_{ci}$—intrinsic coercivity β—temperature coefficient of coercivity MOT—maximum operating temperature $T_c$—Curie temperature The equal to or less than (≦) temperature coefficient of coercivity designations in the specification and claims indicate that the associated negative members decrease algebraically, e.g. −0.2%, −0.3%, −0.4% . . . .

What is claimed:

1. A rare earth element containing permanent magnet having a Curie temperature of ≧750° C., a temperature coefficient of intrinsic coercivity of ≦−0.2%/°C., intrinsic coercivity at room temperature of ≧10 $kO_e$, a temperature coefficient of remanence of ≦−0.1%/°C., remanence at room temperature of ≧8 kG, and an energy product at room temperature of ≧15 $MGO_e$, with a maximum operating temperature of ≧300° C.

2. The permanent magnet of claim 1, wherein the Curie temperature is ≧800° C., the temperature coefficient of intrinsic coercivity is ≦−0.15%/°C., the intrinsic coercivity at room temperature is ≧15 $kO_e$, the temperature coefficient of remanence is ≦−0.03%/°C., the remanence at room temperature is ≧8 kG, and the energy product at room temperature is ≧15 $MGO_e$, with the maximum operating temperature being ≧500° C.

3. The permanent magnet of claim 2, wherein the temperature coefficient of intrinsic coercivity is ≦−0.10%/°C., the intrinsic coercivity at room temperature is ≧20 $kO_e$, the temperature coefficient of remanence is ≦−0.02%/°C., the remanence at room temperature is ≧8 kG, and the energy product at room temperature is ≧15 $MGO_e$, with the maximum operating temperature being ≧700° C.

4. The permanent magnet of claim 1, 2, or 3, having a microstructure comprising a $Sm_2Co_{17}$ phase cell structure and a $Sm_1Co_5$ phase cell boundaries.

5. The permanent magnet of claim 4, consisting essentially of $Sm(Co_{1-x-y-z}Fe_xCu_yM_z)_w$, where w is 6 to 8.5, x is 0.10 to 0.30, y is 0.05 to 0.15, z is 0.01 to 0.04, wherein a heavy rare earth element may be substituted for Sm in an amount up to 50%, M is at least one Zr, Hf, Ti, Mn, Cr, Nb, Mo, and W.

6. The permanent magnet alloy of claim 5, wherein w is 6.5 to 7.5.

* * * * *